US007758285B2

(12) United States Patent
O'Dell

(10) Patent No.: US 7,758,285 B2
(45) Date of Patent: Jul. 20, 2010

(54) SLIT FENCE INSTALLING MACHINE

(76) Inventor: John O'Dell, 6773 CR7, Arlington, NE (US) 68002

( * ) Notice: Subject to any disclaimer, the term of this patent is extended or adjusted under 35 U.S.C. 154(b) by 96 days.

(21) Appl. No.: 12/157,048

(22) Filed: Jun. 6, 2008

(65) Prior Publication Data

US 2009/0304460 A1 Dec. 10, 2009

(51) Int. Cl.
*E02D 17/13* (2006.01)
*E02D 17/20* (2006.01)

(52) U.S. Cl. ..... 405/302.6; 405/302.7; 405/183; 37/367; 37/404; 172/720

(58) Field of Classification Search ..... 405/116, 405/183, 302.6, 302.7; 37/367, 370, 372, 37/380; 172/699, 720
See application file for complete search history.

(56) References Cited

U.S. PATENT DOCUMENTS

| | | | | |
|---|---|---|---|---|
| 2,706,362 | A * | 4/1955 | Arnold | 43/124 |
| 6,318,006 | B1 * | 11/2001 | Hall | 37/367 |
| 7,044,689 | B1 | 5/2006 | McCormick | |
| 7,144,202 | B2 | 12/2006 | McCormick | |

* cited by examiner

*Primary Examiner*—David J Bagnell
*Assistant Examiner*—Benjamin Fiorello
(74) *Attorney, Agent, or Firm*—Dennis L. Thomte; Thomte Patent Law Office LLC

(57) ABSTRACT

A gooseneck frame is attached to the forward ends of a pair of lift arms which extend forwardly from a vehicle such as a skid steer vehicle with the forward end of the gooseneck frame being secured to the forward end of a silt fence installing machine so that the silt fence installing machine is pulled through the ground in advance of the vehicle. An improved coulter disk includes a cylindrical hub which limits the downward movement of the coulter disc with respect to the ground.

6 Claims, 6 Drawing Sheets

SLIT FENCE INSTALLING MACHINE

BACKGROUND OF THE INVENTION

1. Field of the Invention

This invention relates to a silt fence installing machine and more particularly to a silt fence installing machine which is positioned forwardly of a vehicle having a pair of lift arms extending forwardly therefrom. A gooseneck frame is secured to the forward ends of the lift arms and extends upwardly, thence forwardly, and thence downwardly therefrom. The silt frame installing machine itself is secured to the lower end of the downwardly extending portion at the forward end of the gooseneck frame so that the silt frame installing machine is pulled forwardly with respect to the vehicle by means of the gooseneck frame means. More particularly, the invention also includes a ground engaging coulter having a large ground engaging cylindrical hub portion which engages the ground to limit the downward movement of the silt frame installing machine as the machine is moved forwardly.

2. Description of the Related Art

A silt fence is commonly used at construction sites to restrain movement of surface water and silt to reduce erosion. Typically, the silt fence is comprised of a fabric material which permits surface water to flow therethrough while preventing or at least reducing the flow of silt therethrough. In most cases, a narrow trench, furrow or slit is formed in the ground and the lower edge of the silt fence material is inserted downwardly thereinto to anchor the lower end of the silt fence in the ground. The upstanding portion of the silt fence is normally supported by stakes or posts driven into the ground with the fabric material being secured to the stakes or posts.

Silt fence installing machines have been provided to create a trench, furrow or slit in the ground and to position the lower edge of a fabric material into the trench, furrow or slit. One type of slit fence installing machine is illustrated in U.S. Pat. No. 5,915,878. In the '878 patent, the silt fence installing machine is attached to a three-point hitch at the rear end of a towing vehicle. The vehicle pulls the silt fence installing machine forwardly and it is necessary for the operator to constantly turn around to view the operation of the machine. The placement of the silt fence installation machine at the rear end of the vehicle also reduces the maneuverability of the vehicle and machine when turning corners or the like.

Another silt fence installing machine is disclosed in U.S. Pat. No. 7,044,689. Although the machine disclosed in the '689 patent performs satisfactorily, the machine of the '689 patent is pulled behind a tractor or the like which also requires the operator to constantly turn around to view the operation of the machine. The rear mounting of the machine also affects the maneuverability of the tractor and machine when turning corners or the like. In the '689 machine, a coulter wheel is provided which slices into the ground in advance of the plow member but there is no convenient means for controlling the depth of the penetration of the coulter into the ground.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A silt fence installing machine is disclosed which is positioned forwardly of a vehicle having a pair of lift arms pivotally secured thereto which extend forwardly therefrom. A gooseneck frame means is secured to the forward ends of the lift arms of the vehicle and has an upstanding first frame portion, having upper and lower ends, secured to the forward ends of the lift arms. The support frame means also includes a second frame portion, having rearward and forward ends, which is secured at its rearward end to the first frame portion adjacent the upper end thereof and which extends forwardly therefrom. A third frame portion, having upper and lower ends, is secured to the forward end of the second frame portion and extends downwardly therefrom. The gooseneck frame means is designed to support a silt fence machine for installing a silt fence into the ground which has forward and rearward ends. The silt fence installing machine is secured at its forward end to the third frame portion of to gooseneck frame means and extends rearwardly therefrom below the second frame portion towards the first frame portion whereby the vehicle may be driven forwardly to cause the silt fence machine to install a silt fence into the ground forwardly of the vehicle. The instant invention also relates to a coulter wheel having an enlarged central hub which is operatively connected to the silt fence machine to limit the downward movement of the silt fence installation machine into the ground.

Therefore, it is a principal object of the invention to provide an improved coulter for use with a silt fence installing machine.

Still another object of the invention is to provide an improved gooseneck frame structure for a silt fence installing machine which is attached at its rearward end to the forward ends of the lift arms of the vehicle and which extends upwardly, thence forwardly and thence downwardly for connection to the forward end of the silt fence machine.

Still another object of the invention is to provide a silt fence installing machine which is positioned at the forward end of the vehicle with the vehicle being driven forwardly which enables the operator of the vehicle to more conveniently visually observe the operation of the machine without constantly turning his/her head to the rear as in the prior art devices.

Still another object of the invention is to provide a gooseneck structure for attachment to the forward end of the lift arms of a vehicle so that the vehicle may be driven forwardly to pull a silt fence installing machine forwardly.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION OF THE INVENTION

Figure 1:
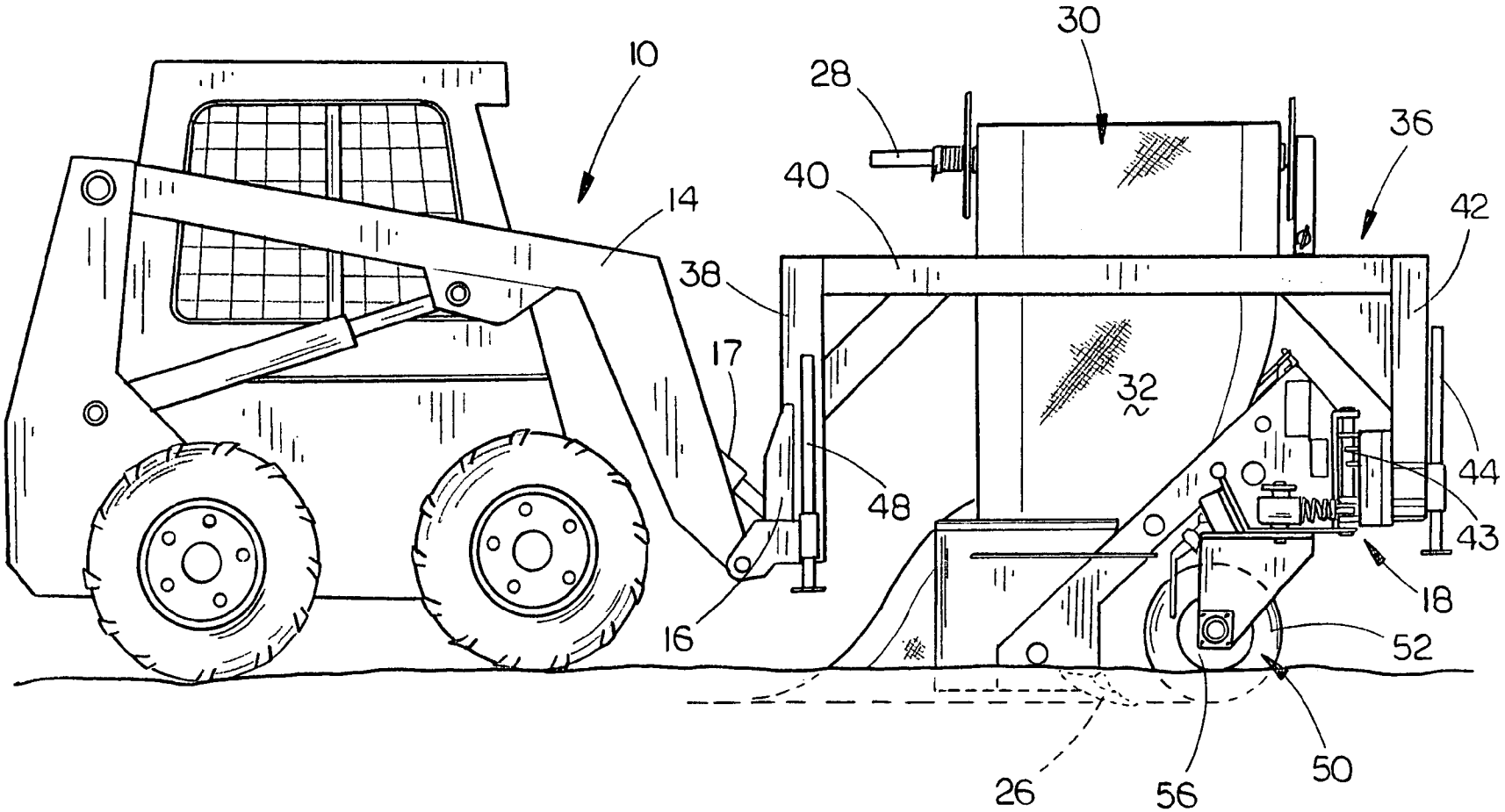
FIG. 1 is a side view of a silt fence installing machine mounted at the forward end of a vehicle such as a skid steer tractor.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to a vehicle such as a skid steer vehicle having a pair of lift arms 12 and 14 pivotally secured thereto and which extend forwardly therefrom in conventional fashion. Usually, a quick attach hitch 16 of conventional design will be secured to the forward ends of the lift arms. Normally, the hitch attachment 16 will be pivotally movable with respect to the lift arms 12 and 14 by means of one or more hydraulic cylinders 17 of conventional design.

The numeral 18 refers to a silt fence installing machine such as the Burchland XTS silt fence installing machine which is marketed by Burchland Manufacturing, Inc., 3311 Yates Avenue, Gilman, Iowa 50106. It is believed that the Burchland XTS silt fence installing machine is the subject of U.S. Pat. No. 7,044,689. Another type of a silt fence installing machine is disclosed in U.S. Pat. No. 5,915,878. Inasmuch as the instant invention has been built to accommodate a Burchland XTS silt fence installing machine, that machine is illustrated in the drawings.

Figure 3:
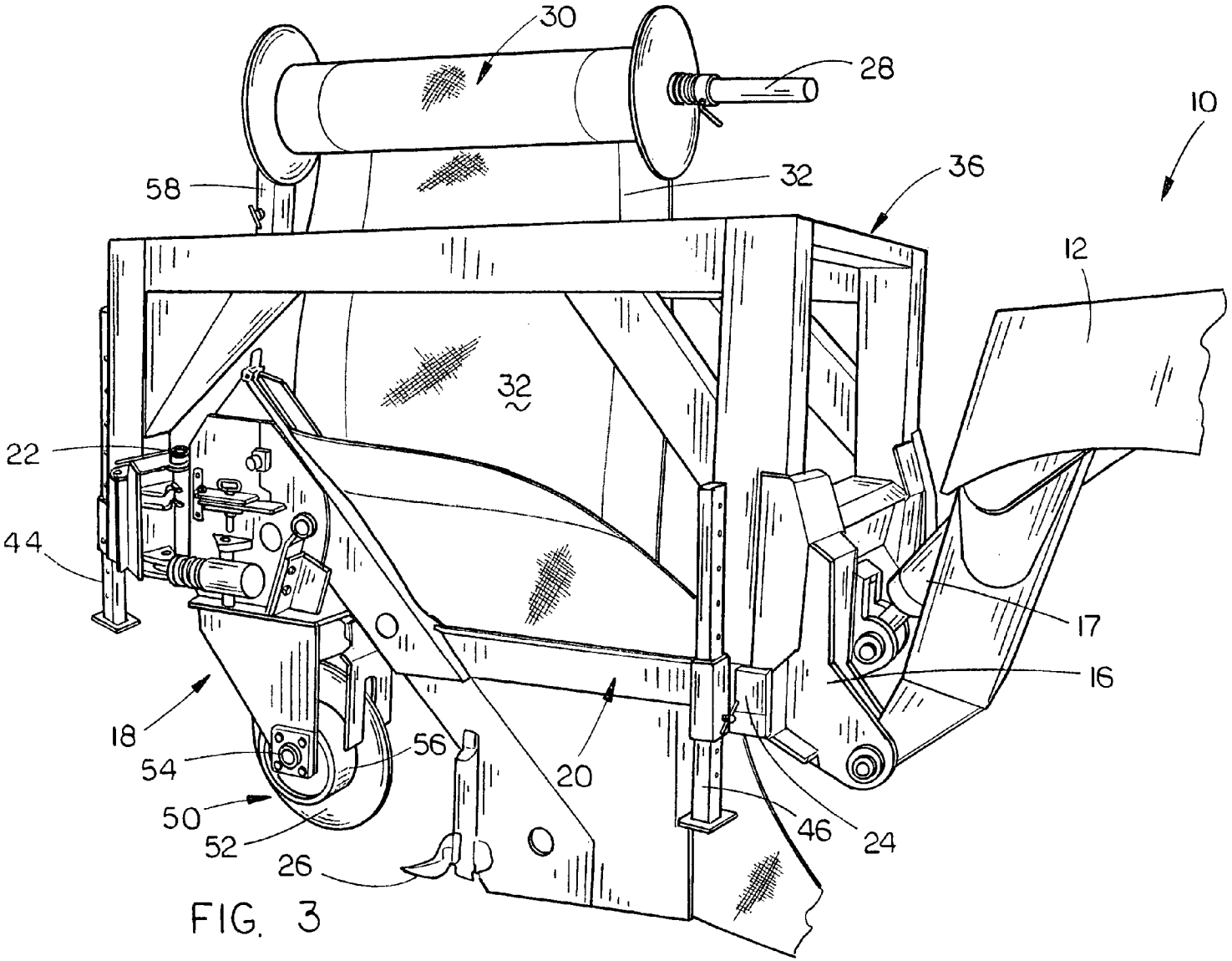
FIG. 3 is a partial rear perspective view of the silt fence machine and which illustrates its relationship with respect to the gooseneck frame of this invention.
Figure 4:
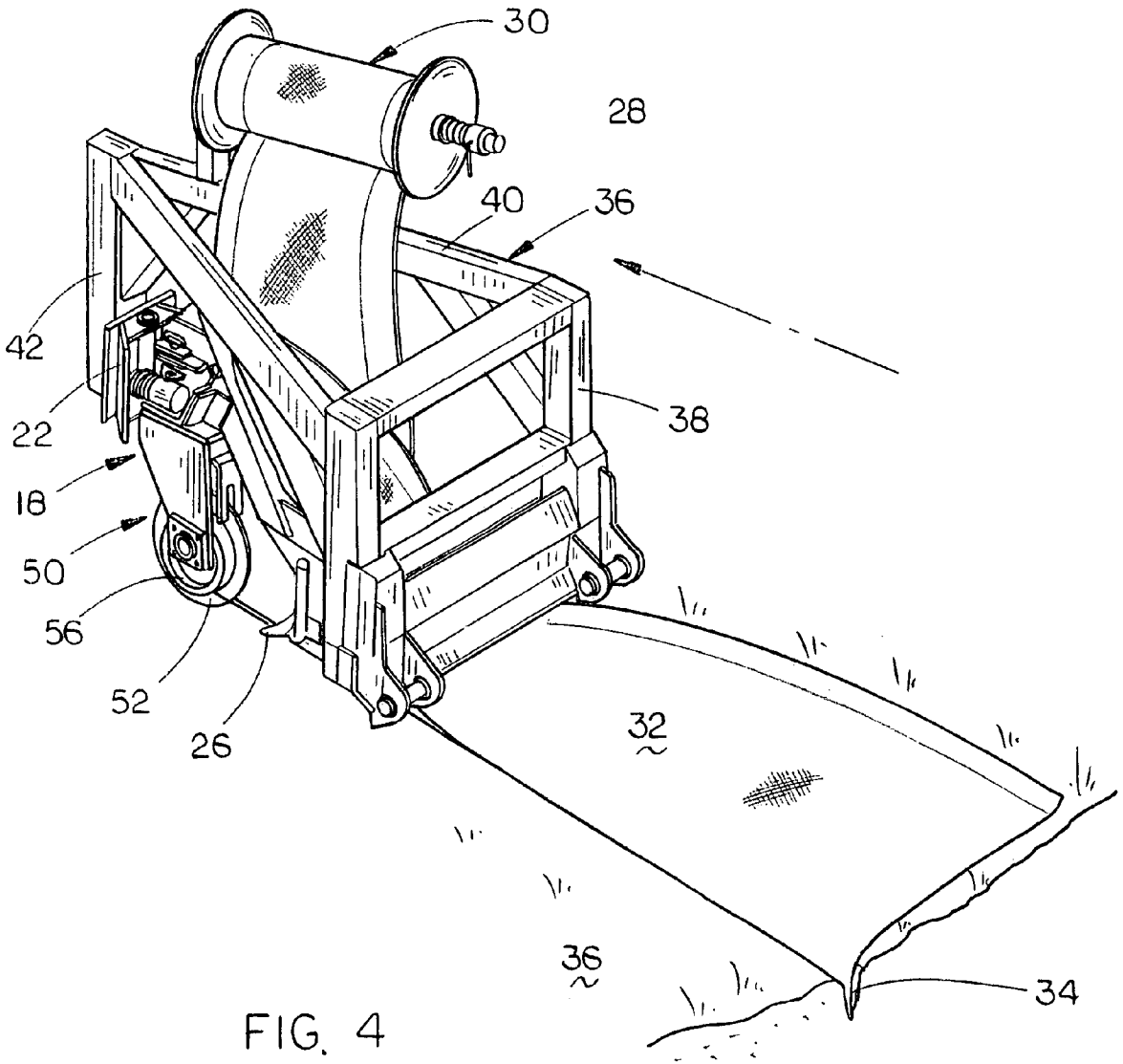
FIG. 4 is a rear perspective view of the gooseneck frame of this invention and its relationship to the silt fence installing machine.
Figure 5:
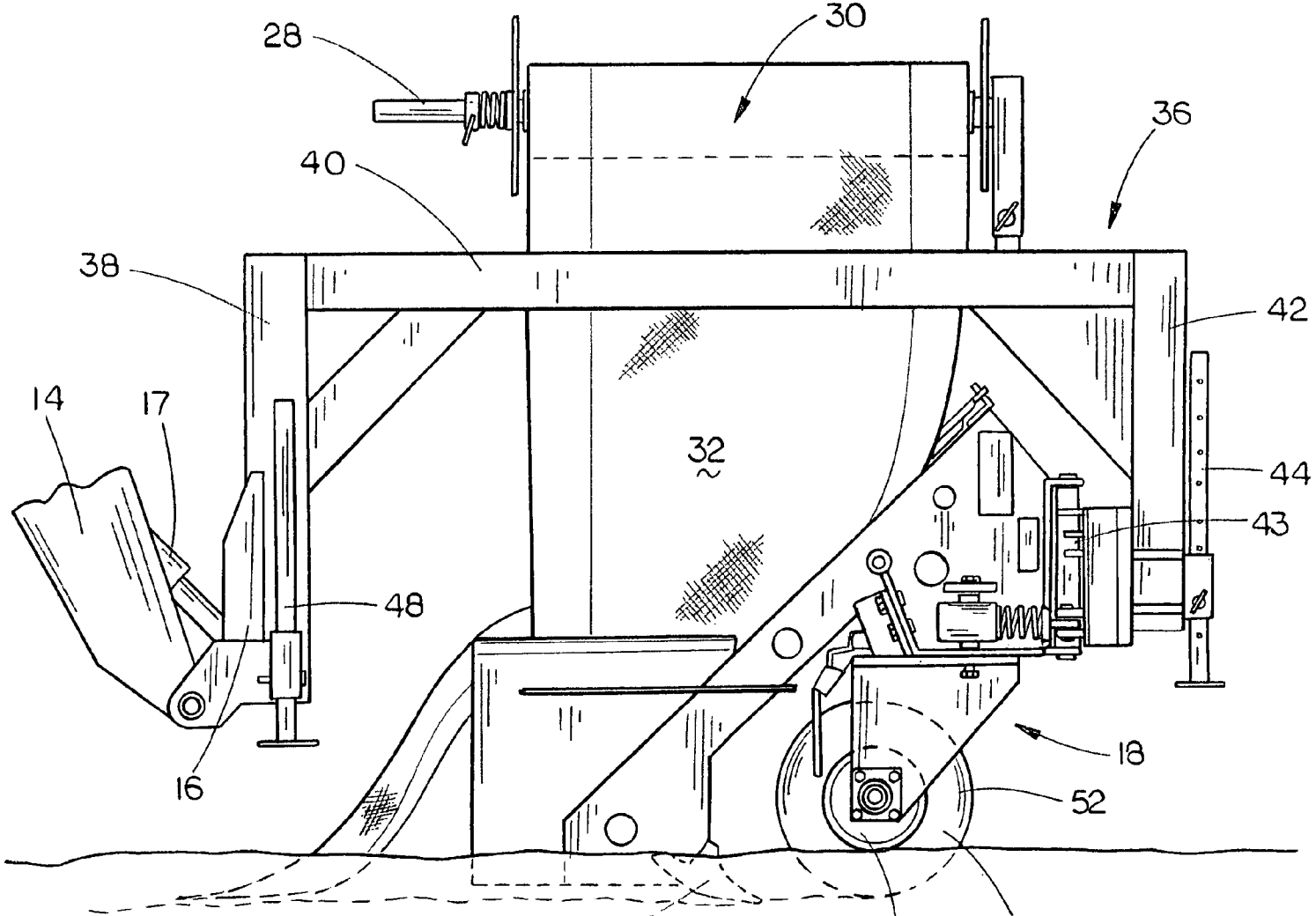
FIG. 5 is a side view of the silt fence installing machine.
Figure 6:
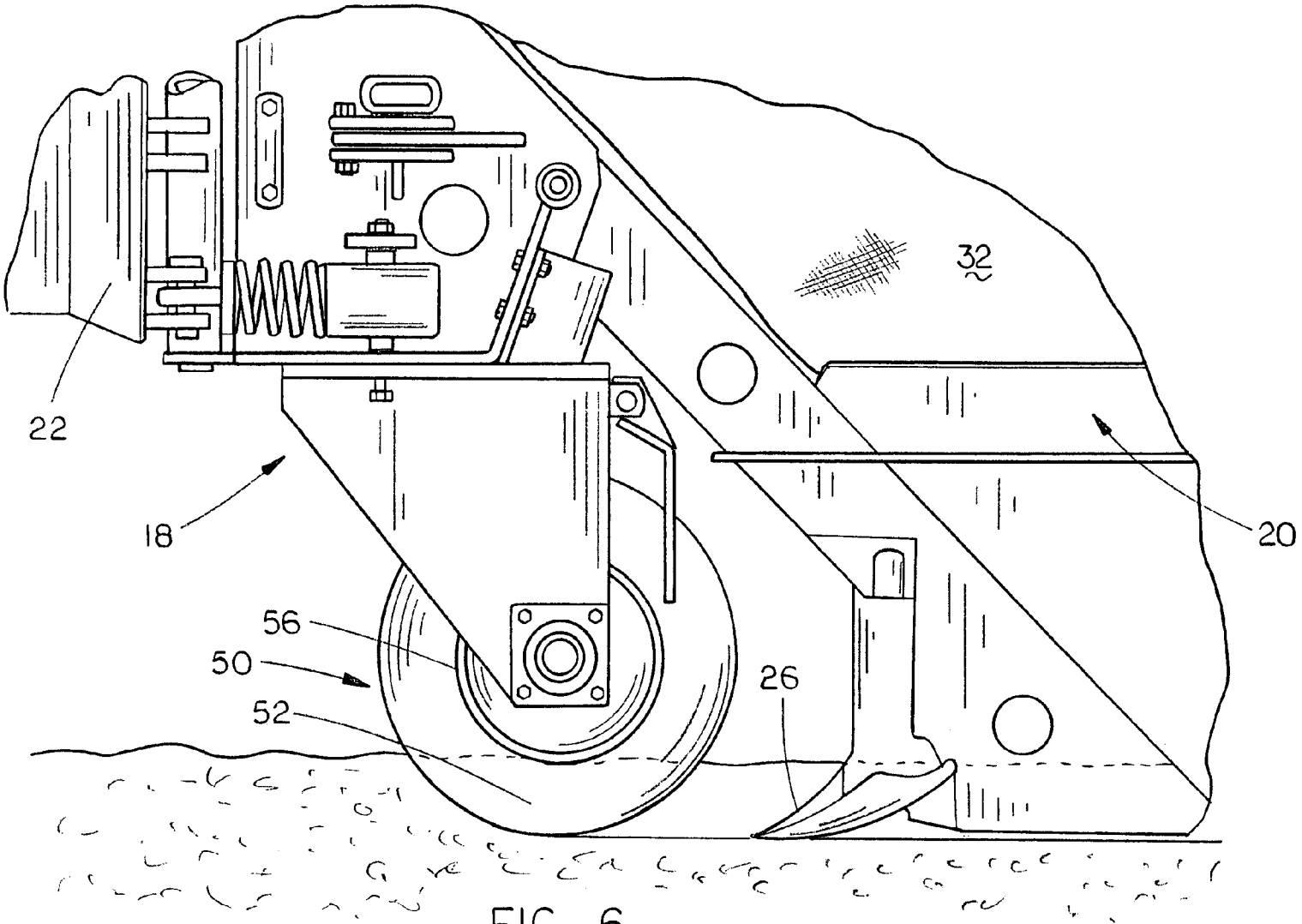
FIG. 6 is a partial side of the silt fence installing machine.

Machine 18 will be described as having a frame 20, a forward end 22, a rearward end 24, a plow member 26, a horizontal pipe or rod 28 for supporting a roll 30 of fabric 32 (FIG. 3). Normally, the pipe or rod 28 is supported on the frame 20 but in this case, the pipe or rod 28 is supported from the gooseneck frame of this invention. As the machine is moved forwardly, the fabric 32 is pulled alongside plow member 26 in an upright orientation and its lower portion 34 is retained in the seam created by plow member with about 12 to 18 inches of fabric 32 remaining above the soil or ground 36 to serve as a silt fence. Usually, posts will be subsequently installed along the silt fence and the upper part of the fence will be attached to the posts in order to cause the silt fence to remain upright. In many cases, a coulter disk is employed to slice through the soil in advance of the plow member 26 to create a vertical seam in the soil.

Figure 2:
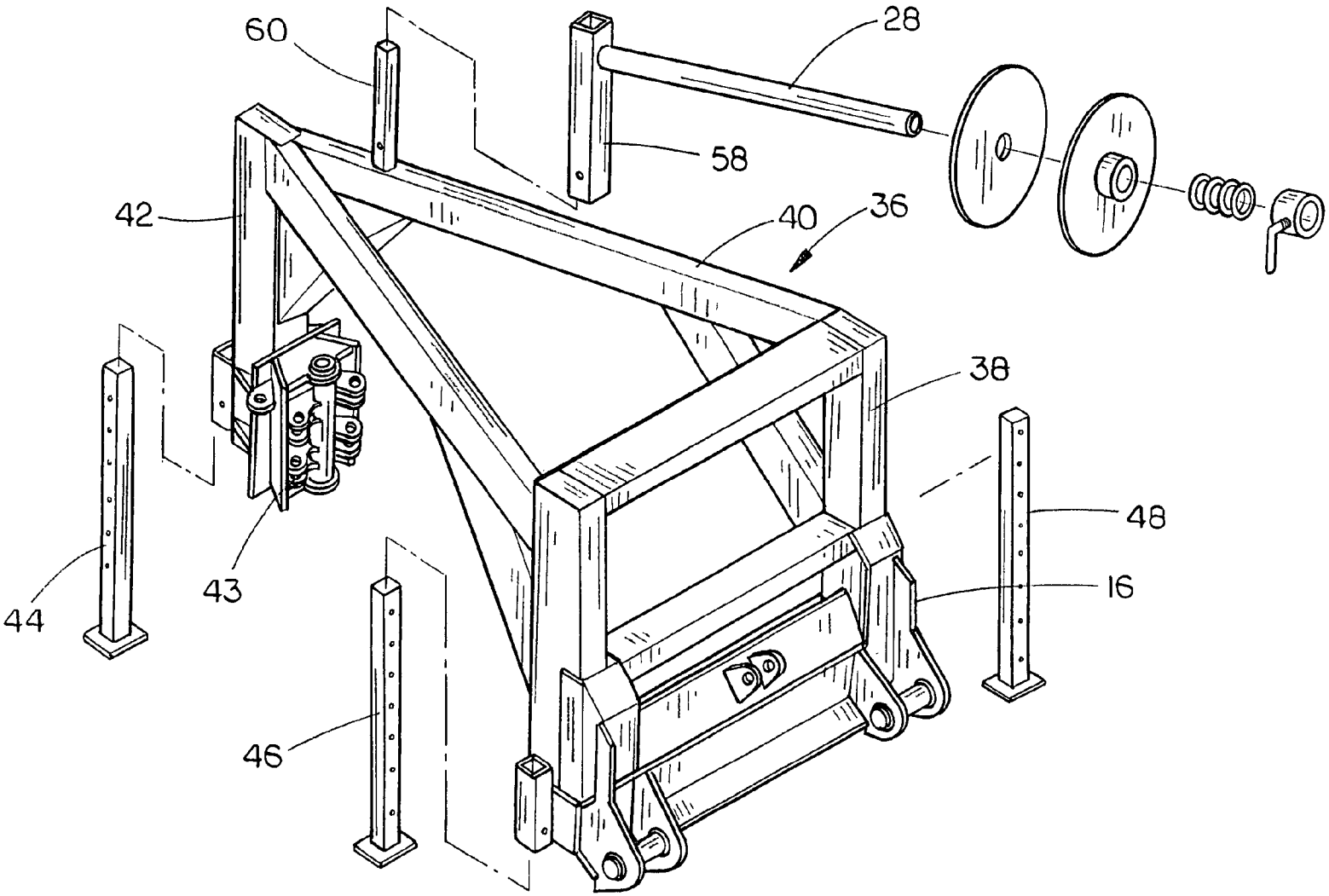
FIG. 2 is an exploded perspective view of the gooseneck frame which is secured at its rearward end to the forward ends of the vehicle boom arms and which has the forward end of the silt fence installing machine secured to the forward end thereof.

In order for the machine 18 to be pulled through the soil in front of the vehicle 10, a gooseneck support frame means 36 is provided. Frame means 36 includes a first frame portion 38, a second frame portion 40 and a third frame portion 42. First frame portion 38 is generally vertically disposed and has its lower end secured to a hitch which is secured to the quick attach hitch 16 and which extends upwardly therefrom. The second frame portion 40 extends generally horizontally forwardly from the upper end of frame portion 38 in a converging fashion (FIG. 2). Frame portion 42 is secured at its upper end, to the forward end of frame portion 42 and extends downwardly therefrom. A hitch mechanism 43 is secured to the lower rearward end of frame portion 42 as seen in FIG. 2.

The forward end 22 of frame 20 of machine 18 is secured to the hitch mechanism 43 as seen in FIG. 3. As seen in the drawings, machine 18 extends rearwardly from frame portion 42 below frame portion 40 towards frame portion 38 so that the machine 18 is pulled forwardly by the frame means 36 forwardly of the vehicle 10 so that the operator can observe the operation of the machine 18 without having to turn around on the vehicle to observe the machine as is the case with the prior art machines. Further, the machine 18 seems to be easier to maneuver with the machine positioned forwardly of the vehicle 10, especially when turning corners or changing directions.

Support legs 44, 46 and 48 are vertically adjustably mounted on the frame means 36 (FIG. 2) to support the frame means 36 and the machine 18 on the ground when the frame means 36 is disconnected from the lift arms 12 and 14. The only substantive modification of the machine 18 is the attachment of the machine 18 to hitch mechanism 43 and to replace the conventional coulter disk with the modified coulter disk 50. Coulter disk 50 includes a disk 52 which has an axle 54 horizontally rotatably mounted on the frame 20. A cylindrical hub 56 is positioned on both sides of the disk 52 and is adapted to engage the ground to limit the depth that the disk 52 will slice into the ground in advance of the plow member 26. The coulter disk 50 is believed to be useful with any ground working implements such as planters, etc.

As seen, rod 28 is secured to tube 58 which is mounted on tube 60 which is secured to frame portion 40 of frame means 36.

It can therefore be seen that a novel gooseneck support frame means 36 has been provided which is secured to the forward ends of the lift arms of a skid steer vehicle or the like with the silt fence installing machine being secured to the forward end of the gooseneck support frame means 36 so that the silt fence installing machine 18 is pulled forwardly along the ground in advance of the vehicle 10 so that the operator of the vehicle 10 may constantly view the machine 18 without having to constantly turn around to view the machine as is the case with the prior art silt fence installing machine. Further, the operator of the vehicle 10 is able to more easily maneuver the silt fence installing machine 18 to follow a predesignated line where the fence is to be installed and which is more maneuverable when the silt fence installing machine 18 is going around corners or the like. Further, it can also be seen that a novel coulter disc 50 has been provided which limits the penetration of the coulter disc and the machine 10 into the ground so that the lower end of the silt fence fabric is more evenly positioned within the ground. It can, therefore, be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. In combination with a vehicle having rearward and forward ends and a pair of lift arms pivotally secured thereto which extend forwardly therefrom, comprising:

a support frame means having rearward and forward ends;

said support frame means including an upstanding first frame portion, having upper and lower ends, which is secured to the forward ends of the lift arms for movement therewith, a second substantially horizontally disposed frame portion, having rearward and forward ends, secured at its rearward end to said first frame portion adjacent the upper end thereof and which extends forwardly therefrom, a third frame portion, having upper and lower ends, secured to said second frame portion adjacent the forward end thereof, and extending downwardly therefrom;

a silt fence installing machine having rearward and forward ends;

said silt frame installing machine being secured at its forward end to said third frame portion and extending rearwardly therefrom below said second frame portion towards said first frame portion whereby the vehicle, upon being driven in a forward direction, will pull said silt fence installing machine forwardly by way of said support frame means, so that said silt fence installing machine will install a silt fence into the ground forwardly of the vehicle.

2. The combination of claim 1 wherein said first, second and third frame portions define a gooseneck-type supporting frame for said silt fence installing machine.

3. The combination of claim 1 wherein said silt fence installing machine includes a vertically disposed coulter disk having an enlarged horizontally disposed cylindrical hub secured thereto which is adapted to engage the ground to limit the downward movement of said coulter disk into the ground.

4. The combination of claim 1 wherein the vehicle comprises a skid steer vehicle.

5. In combination with a vehicle having rearward and forward ends and a pair of lift arms pivotally secured thereto which extend forwardly therefrom, comprising:

a gooseneck frame means having a rearward end and a forward end;

said rearward end of said gooseneck frame means being secured to the forward ends of the vehicle lift arms for movement therewith;

a silt fence installing machine, having rearward and forward ends adapted to install a silt fence into the ground as the silt fence installing machine is moved forwardly;

said silt fence installing machine being secured at its forward end to the forward end of said gooseneck frame means and extending rearwardly therefrom whereby said silt fence installing machine will be pulled forwardly by said gooseneck frame means to install a silt fence into the ground forwardly of the vehicle as the vehicle moves forwardly.

6. The combination of claim 5 wherein said silt fence installing machine includes a vertically disposed coulter disk having an enlarged horizontally disposed cylindrical hub secured thereto which is adapted to engage the ground to limit the downward movement of said coulter disk into the ground.

* * * * *